US007594641B2

(12) United States Patent
Sharp

(10) Patent No.: US 7,594,641 B2
(45) Date of Patent: Sep. 29, 2009

(54) HITCH INSTALLATION HOIST

(75) Inventor: Gene Sharp, Mesa, AZ (US)

(73) Assignee: U-Haul International, Inc., Phoenix, AZ (US)

( * ) Notice: Subject to any disclaimer, the term of this patent is extended or adjusted under 35 U.S.C. 154(b) by 0 days.

(21) Appl. No.: 12/020,493

(22) Filed: Jan. 25, 2008

(65) Prior Publication Data

US 2009/0189133 A1 Jul. 30, 2009

(51) Int. Cl.
*B66D 1/36* (2006.01)

(52) U.S. Cl. ..... 254/325; 254/334; 414/543

(58) Field of Classification Search ..... 254/324, 254/325, 334; 414/543
See application file for complete search history.

(56) References Cited

U.S. PATENT DOCUMENTS

| | | | | | |
|---|---|---|---|---|---|
| 2,419,813 | A | | 4/1947 | Berchtold | |
| 3,007,592 | A | | 11/1961 | Adams | |
| 4,181,290 | A | | 1/1980 | Affolter | |
| 4,962,913 | A | * | 10/1990 | Stewart | 254/269 |
| 5,085,408 | A | * | 2/1992 | Norton et al. | 254/325 |
| 5,100,283 | A | | 3/1992 | Carty | |
| 5,281,078 | A | * | 1/1994 | Mills, Jr. | 414/680 |
| 5,297,913 | A | | 3/1994 | Au | |
| 5,593,139 | A | * | 1/1997 | Julian | 254/325 |
| 5,749,697 | A | * | 5/1998 | Davis | 414/680 |
| 5,913,507 | A | * | 6/1999 | Lauricella, Jr. | 254/325 |
| 6,116,580 | A | | 9/2000 | Hull | |
| 6,202,868 | B1 | * | 3/2001 | Murray | 212/294 |
| 6,499,610 | B2 | * | 12/2002 | Spitsbergen | 212/179 |
| 6,554,254 | B2 | | 4/2003 | Vetesnik | |
| 6,578,722 | B2 | | 6/2003 | Perkins et al. | |
| 7,407,151 | B2 | * | 8/2008 | Rabska et al. | 254/345 |
| 2002/0066710 | A1 | * | 6/2002 | Spitsbergen | 212/179 |
| 2002/0168258 | A1 | * | 11/2002 | Philipps et al. | 414/462 |
| 2004/0256607 | A1 | | 12/2004 | Spitsbergen | |
| 2005/0230340 | A1 | * | 10/2005 | Barger et al. | 212/280 |
| 2006/0045704 | A1 | | 3/2006 | Laufenberg | |
| 2006/0120842 | A1 | * | 6/2006 | Thompson | 414/462 |

* cited by examiner

*Primary Examiner*—Emmanuel M Marcelo
(74) *Attorney, Agent, or Firm*—Richard E. Oney; Tiffany & Bosco, P.A.

(57) ABSTRACT

A portable hoist assembly is provided for lifting a hitch to be installed on the underside of a vehicle platform. The hitch has a hitch ball hole and the vehicle platform has a hole to be aligned with the hitch ball hole when the hitch is installed. The hoist assembly includes a hoist frame and a winch for paying out and drawing in a cable. The winch is supported by the frame above the vehicle platform hole. An elongated member is attached to the cable. The elongated member can be oriented in a first position wherein it can pass through the vehicle platform hole and the hitch ball hole. Also, the elongated member can be oriented in a second position wherein it cannot pass through the hitch ball hole. The elongated member can be lowered through the vehicle platform hole and the hitch ball hole in the first orientation and can secure the cable to the hitch in the second orientation.

20 Claims, 5 Drawing Sheets

HITCH INSTALLATION HOIST

BACKGROUND

The present invention relates generally to hoists. More particularly, it relates to a hoist employed to aid in lifting, positioning and holding a trailer tow hitch beneath a vehicle to facilitate installation of the hitch.

Typically, a trailer hitch assembly mounted on the cargo bed of a vehicle is used to secure a large trailer, such as a gooseneck trailer. Trailer hitch assemblies for use with the cargo bed of a vehicle present inherent problems in installing the hitch assembly. Typically, such hitch assemblies are installed beneath the cargo bed of the vehicle. The weight of the trailer requires the hitch assembly to be of substantial construction. In positioning the hitch beneath a motor vehicle it is necessary to both lift the hitch and tilt the hitch. Because the hitch can be quite heavy, the person installing the hitch usually requires mechanical assistance or the assistance of another person in effecting the different movements required of the hitch.

Previously, hitch hoists have been used for positioning and holding hitches beneath a motor vehicle. Such hoists, however, are relatively complex and expensive. There continues to be a need, therefore, for a hitch hoist that is simple, that is inexpensive in construction, that can be employed by a single person to install a hitch with minimum exertion of effort and that is reliable in operation. It is an object of the present invention to provide such a hoist for installing a hitch beneath the bed of a motor vehicle.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, there is provided a portable hoist assembly for lifting a hitch to be installed on the underside of a vehicle bed, wherein the hitch has a hitch ball hole and the vehicle bed has a hole to be aligned with the hitch ball hole when the hitch is installed. The hoist assembly includes a hoist frame and a winch for paying out and drawing in a cable having an end for securing to the hitch. The winch is supported by the frame above the vehicle bed hole. A rigid elongated member is attached to the cable end. The elongated member can be oriented in a first position wherein it can pass through the vehicle bed hole and the hitch ball hole. Also, the elongated member can be oriented in a second position wherein it cannot pass through the hitch ball hole. In this configuration, the elongated member can be lowered through the vehicle bed hole and the hitch ball hole in the first orientation and can secure the cable to the hitch in the second orientation.

In one suitable embodiment, the elongated member can be in the form of a rigid tube or pin. The elongated member has a length greater than the diameter of the hitch ball hole. In a preferred embodiment, the elongated member includes a rigid tube that has a length less than the diameter of the hitch ball hole and a pin that can be positioned within the tube and that has a length greater than the diameter of the hitch ball hole.

To install a hitch assembly, the hoist is positioned in the vehicle bed such that the winch is supported above the vehicle platform hole. The elongated member is lowered through the vehicle platform hole and the hitch ball hole in the first orientation. The elongated member is then secured to the hitch by placing it in the second orientation after it is lowered through the hitch ball hole. The hitch is then lifted into position for installation to the underside of the vehicle bed.

BRIEF DESCRIPTION OF THE DRAWINGS

The accompanying drawings, which are incorporated in and constitute a part of the specification, illustrate the presently preferred embodiments of the invention, and together with the general description given above and the detailed description of the preferred methods and embodiments given below, serve to explain the principles of the invention.

DETAILED DESCRIPTION

Figure 1:
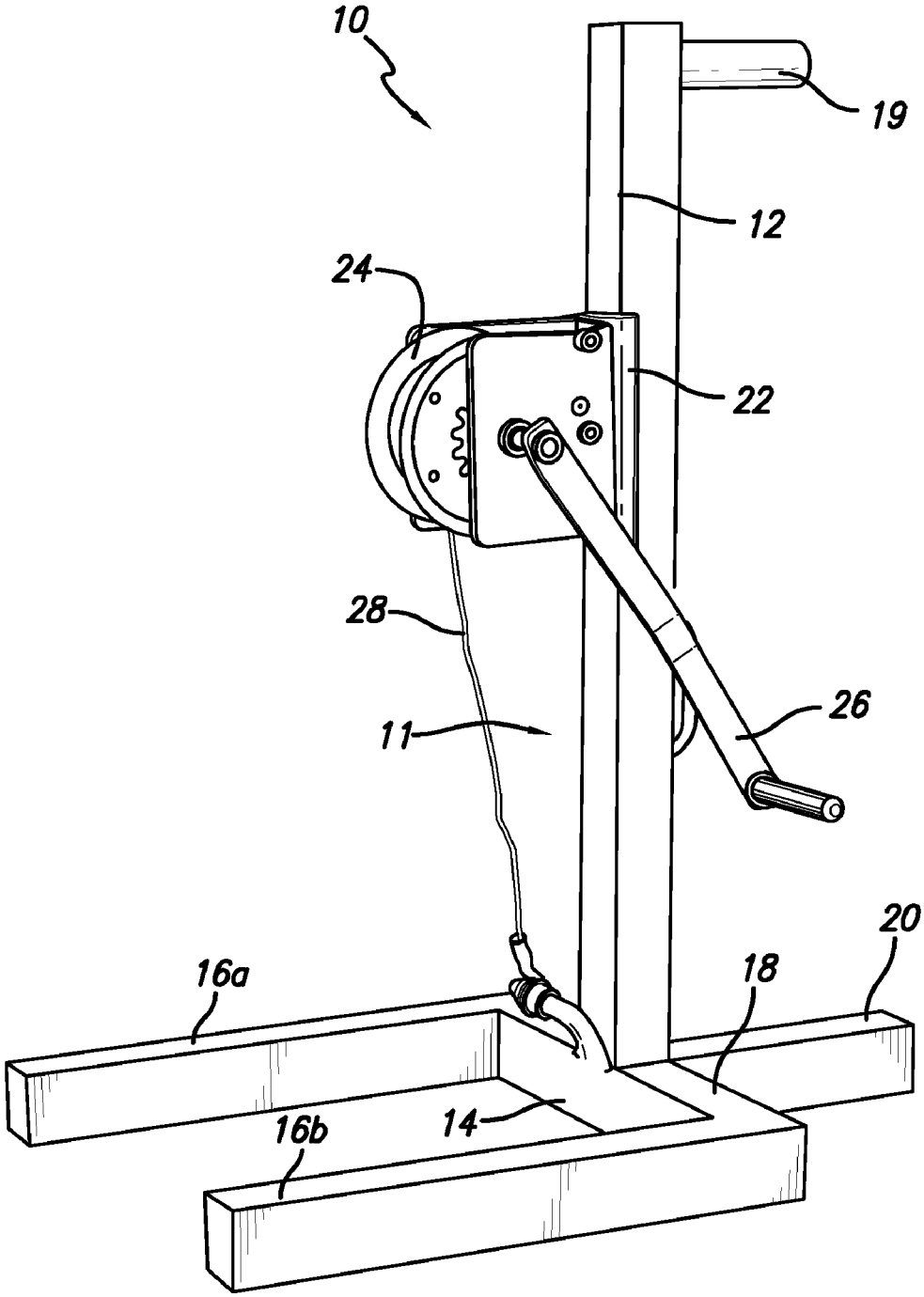
FIG. 1 is a front-right perspective view showing a hoist according to the present invention.
Figure 2:
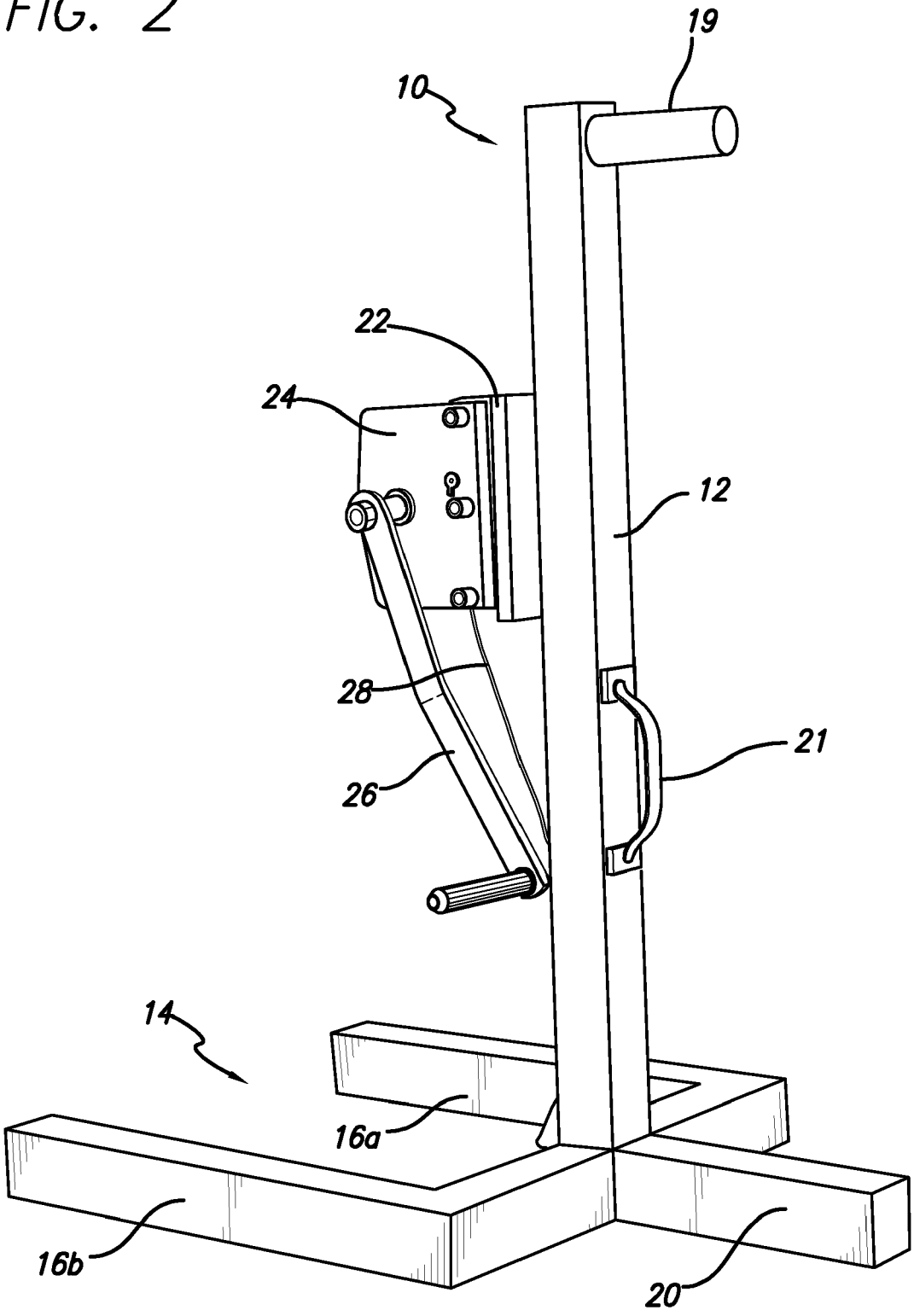
FIG. 2 is a rear-right perspective view of the hoist of FIG. 1.
Figure 3:
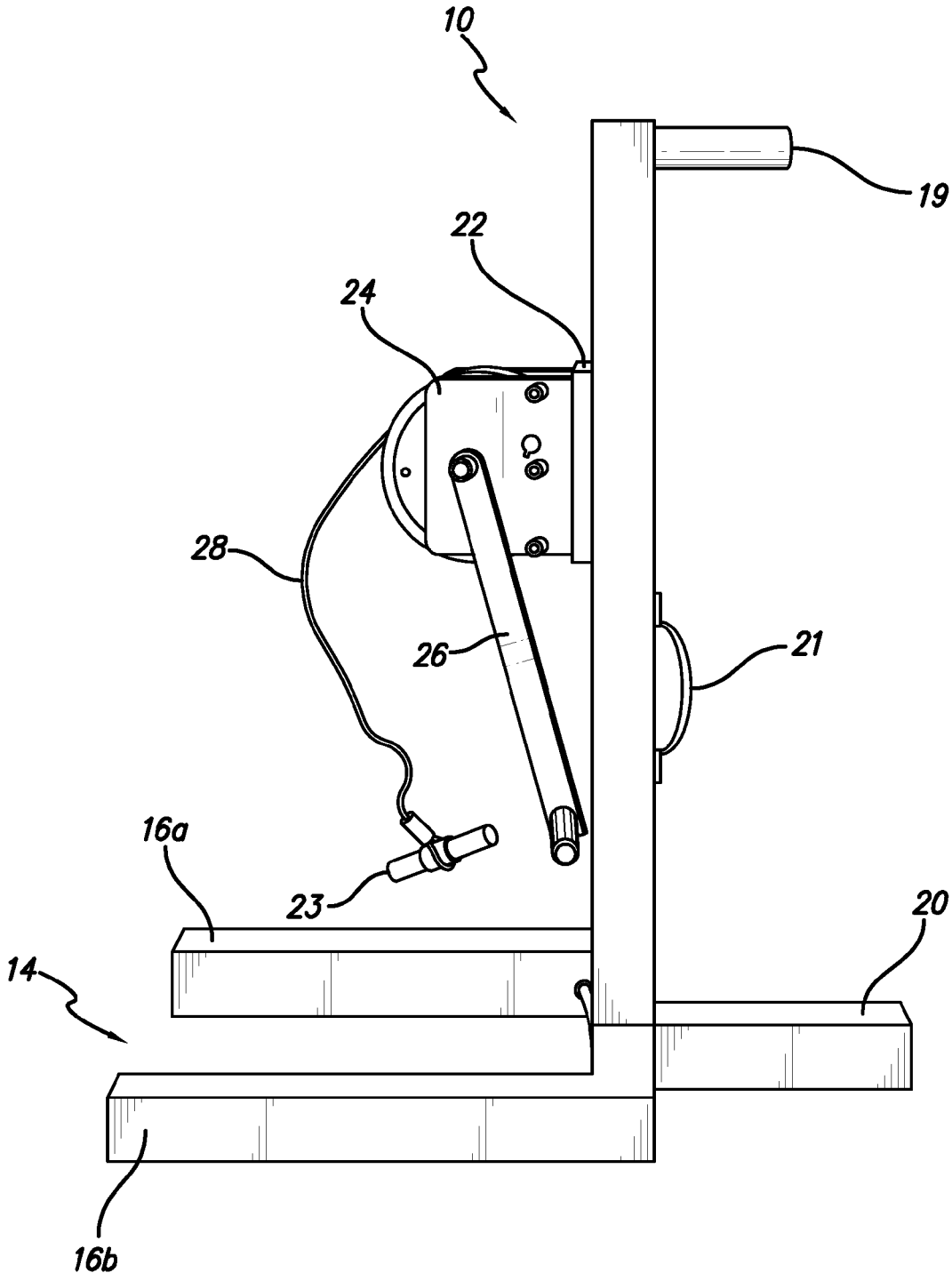
FIG. 3 is a right side perspective view of the hoist of FIG. 1.

Reference will now be made in more detail to presently preferred methods and embodiments of the invention, as illustrated in the accompanying drawings. While the invention is described more fully with reference to these examples and drawings, the invention in its broader aspects is not limited to the specific details, representative devices, and illustrative examples shown and described. Rather, the description which follows is to be understood as a broad, teaching disclosure directed to persons of ordinary skill in the appropriate arts, and not as limiting upon the invention.

In the drawings, the reference numeral 10 designates generally a hitch hoist in accordance with the invention. The hoist 10 includes a frame 11 that includes an upright member 12 mounted to a platform 14. The platform 14 is fabricated from two longitudinal tubular members 16*a*, 16*b*, a transverse tubular member 18 and an opposing longitudinal member 20. The longitudinal members 16*a*, 16*b* are connected to the transverse member 18 and extend perpendicularly to one side of the upright member 12. The opposing longitudinal member 20 also is connected to the transverse member 18 and extends perpendicularly to an opposing side of the upright member 12. The hoist 10 is provided with a hand grip 19 near the top of the upright member 12 for lifting and positioning the hoist 10. A handle 21 is mounted near the midpoint of the upright member 12 for carrying the hoist 10.

In a presently preferred embodiment, the upright member 12, the longitudinal members 16*a*, 16*b*, the transverse member 18 and the opposing longitudinal member 20 are fabricated from tubular stock, which preferably has a non-circular cross-sectional shape, such as a rectangle or square. A preferred material for the stock is steel. Upon reading this disclosure, however, those of skill in the art will recognize that the tubular stock my be fabricated from other suitable material, such as aluminum or other suitable metals. The upright member 12, longitudinal members 16*a*, 16*b*, transverse member 18 and opposing longitudinal member 20 are welded together to form the frame 11.

A winch plate 22 is affixed to the front face of the upright member 12 for mounting a winch 24 to the frame 11. The winch 24 is bolted or otherwise affixed to the winch plate 22. The winch 24 is operated by a hand crank 26 and can be operated in both a forward and reverse direction to reel in or pay out a length of cable 28. In one exemplary embodiment, the winch 24 can be equipped with a friction clutch (not shown) to hold the winch drum in selected positions to which it is turned. In another embodiment, the winch 24 can be a ratcheting pawl winch. In either case, the winch can be operated in both forward and reverse directions.

A rigid elongated member 23 is attached to the end of the cable 28. The elongated member has a length greater than the diameter of the hitch ball hole 38 discussed below. In a preferred embodiment, the elongated member 23 can be in the form of a rigid tube or pin. In another preferred embodiment, the elongated member 23 includes a rigid tube that has a length less than the diameter of the hitch ball hole 38 and a pin that can be slidably positioned within the tube and that has a length greater than the diameter of the hitch ball hole 38. The elongated member is fabricated from a material sufficient to hold the weight of a hitch, such as steel.

Figure 4:
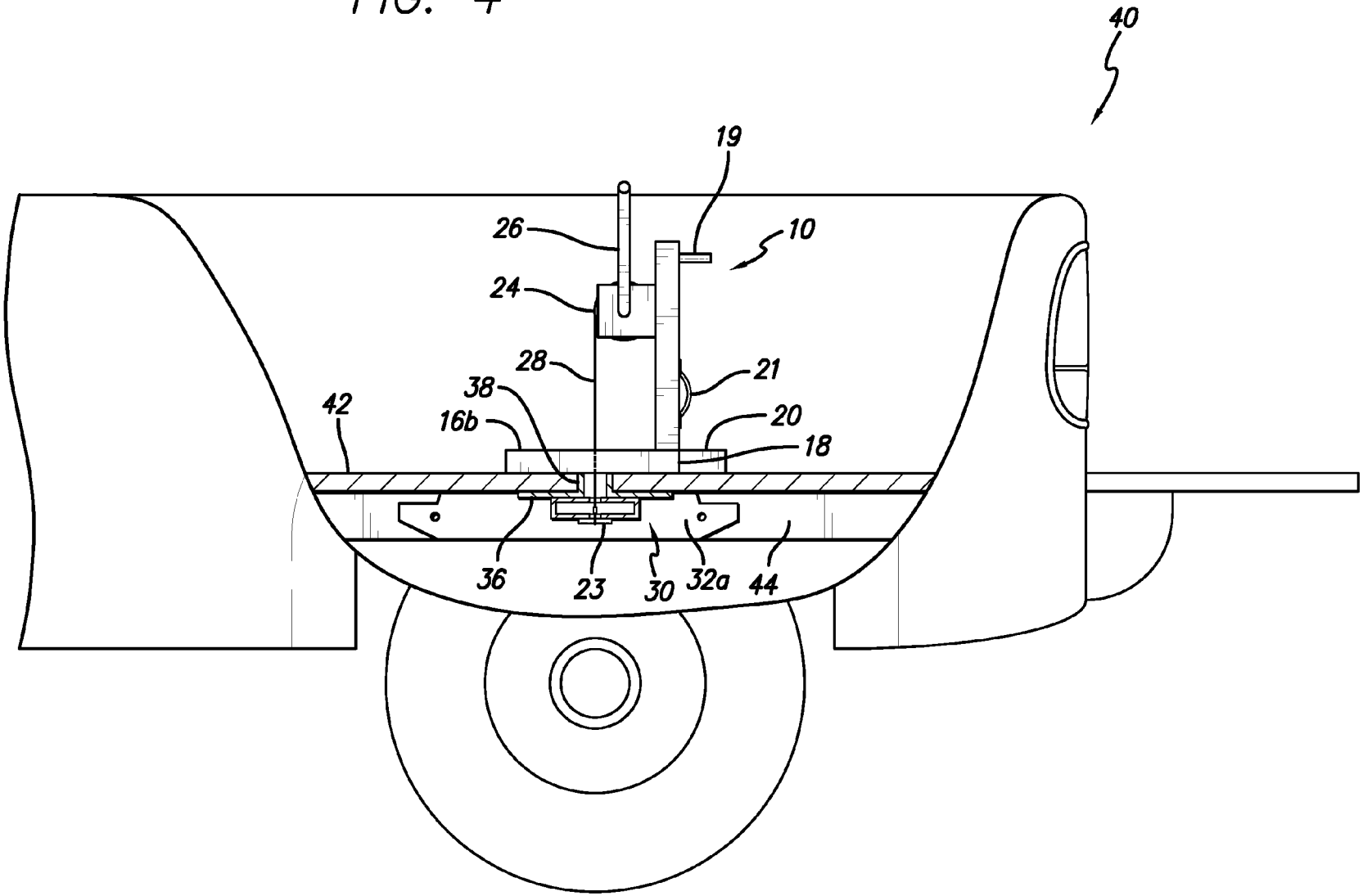
FIG. 4 is a side view of a vehicle in partial cross section showing the hoist of FIG. 1 positioned in the bed of the vehicle and holding a hitch in place below the bed for installation.
Figure 5:
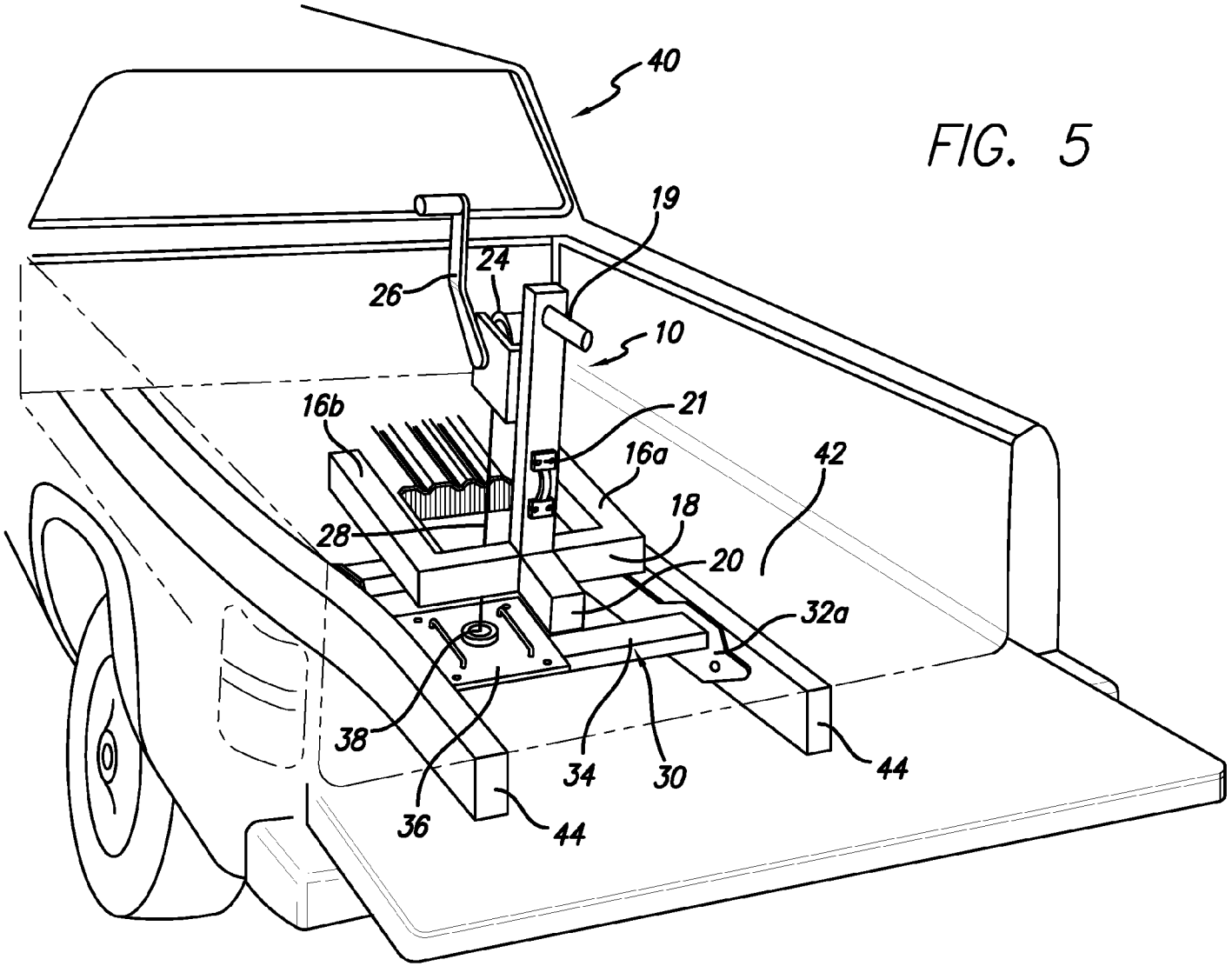
FIG. 5 is a perspective view in partial cross-section showing the hoist of FIG. 1 positioned in the bed of the vehicle of FIG. 4 and holding the trailer hitch in place below the bed for installation.

Referring to FIGS. 4 and 5, in operation the winch 24 is used to raise and lower a hitch 30 to be mounted beneath a cargo bed 42 of a vehicle 40, such as a pick-up truck. Such a hitch is commonly known as a "gooseneck" trailer hitch and typically includes side mounting brackets 32*a*, 32*b* that attach to the vehicle frame 44, cross members 34 joining the mounting brackets 32*a*, 32*b*, and a center portion 36 that attaches to the cross members 34 and provides means for mounting a hitch ball (not shown) including a hitch ball hole 38. Installation of the hitch 30 requires that a hole be cut in the vehicle bed 42 so that the hitch ball is accessible from above.

To install the hitch 30, the hoist 10 is placed in the vehicle bed 42 so that the winch 24 is just above the hole cut in the floor of the vehicle bed for accommodating the hitch ball. In a generally vertical orientation, the elongated member 23 can be lowered through the hole in the vehicle bed 42, through the hitch ball hole 38 in the hitch 30. The elongated member 23 is then secured to the hitch by placing it in a generally horizontal orientation after it is lowered through the hitch ball hole. The hitch 30 is then lifted into position for installation to the underside of the vehicle bed.

From the foregoing it should be apparent that this invention provides a hoist which enables one person to lift a trailer hitch into position beneath the undercarriage of a motor vehicle and to hold the hitch in that position while mounting holes are marked or drilled and while fasteners are installed. The versatility of the hoist permits its use for a variety of types and styles of hitches and a variety of motor vehicles.

Having read this disclosure, it will also be understood by those having skill in the art that the modifications may be made to the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A portable hoist assembly for lifting a hitch to be installed on the underside of a vehicle platform, wherein the hitch has a hitch ball hole and the vehicle platform has a hole to be aligned with the hitch ball hole when the hitch is installed, the hoist assembly and hitch combination comprising:

a hoist frame;

a winch for paying out and drawing in a cable; and an elongated member coupled to the cable such that the elongated member can be oriented in:

a first position wherein the elongated member can pass through the vehicle platform hole and the hitch ball hole; and a second position wherein the elongated member cannot pass through the hitch ball hole;

whereby, in the first position, the elongated member can be lowered through the vehicle platform hole and the hitch ball hole and, in the second position, the elongated member can secure the cable to the hitch; and wherein the elongated member is disposed in the second orientation and the cable supports the hitch.

2. The portable hoist assembly of claim 1 wherein the winch comprises a friction-clutch type winch.

3. The portable hoist assembly of claim 1 wherein the winch comprises a ratcheting pawl.

4. The portable hoist assembly of claim 1 wherein the elongated member comprises a tube.

5. The portable hoist assembly of claim 1 wherein the elongated member has a length greater than the diameter of the hitch ball hole.

6. A portable hoist assembly for lifting a hitch to be installed on the underside of a vehicle platform, wherein the hitch has a hitch ball hole and the vehicle platform has a hole to be aligned with the hitch ball hole when the hitch is installed, the hoist assembly comprising:

a hoist frame;

a winch for paving out and drawing in a cable;

an elongated member coupled to the cable such that the elongated member can be oriented in:

a first position wherein the elongated member can pass through the vehicle platform hole and the hitch ball hole; and a second position wherein the elongated member cannot pass through the hitch ball hole;

whereby, in the first position, the elongated member can be lowered through the vehicle platform hole and the hitch ball hole, and in the second position, can secure the cable to the hitch; and wherein the elongated member comprises:

a tube having a length less than the diameter of the hitch ball hole; and a pin that can be positioned within the tube and that has a length greater than the diameter of the hitch ball hole.

7. A portable hoist assembly for lifting a hitch to be installed on the underside of a vehicle platform, wherein the hitch has a hitch ball hole and the vehicle platform has a hole to be aligned with the hitch ball hole when the hitch is installed, the hoist assembly comprising:

a hoist frame;

a winch for paying out and drawing in a cable;

an elongated member attached to the cable end such that the elongated member can be oriented in:

a first position wherein the elongated member can pass through the vehicle platform hole and the hitch ball hole; and a second position wherein the elongated member cannot pass through the hitch ball hole;

whereby the elongated member can be lowered through the vehicle platform hole and the hitch ball hole in the first position and can secure the cable to the hitch in the second position; and wherein the elongated member comprises a pin.

8. A method for installing a trailer tow hitch on the underside of a vehicle platform, wherein the hitch has a hitch ball hole and the vehicle platform has a hole to be aligned with the hitch ball hole when the hitch is installed, the method comprising:

providing a winch for paying out and drawing in a cable, wherein an elongated member is coupled to the cable such that the elongated member can be oriented in:

a first orientation wherein the elongated member can pass through the vehicle platform hole and the hitch ball hole; and a second orientation wherein the elongated member cannot pass through the hitch ball hole;

supporting the winch above the vehicle platform hole;

lowering the elongated member through the vehicle platform hole and the hitch ball hole in the first orientation; and securing the elongated member to the hitch by placing elongated member in the second orientation after it is lowered through the hitch ball hole.

9. A method of claim 8 further comprising lifting the hitch into position for installation to the underside of the vehicle platform.

10. The method of claim 8 wherein the winch comprises a friction-clutch type winch.

11. The method of claim 8 wherein the winch comprises a ratcheting pawl.

12. The method of claim 8 wherein the elongated member comprises a tube.

13. The method of claim 12 wherein the tube has a length less than the diameter of the hitch ball hole and elongated member further comprises a pin that can be positioned within the tube and that has a length greater than the diameter of the hitch ball hole.

14. The method of claim 8 wherein the elongated member comprises a pin.

15. The method of claim 8 wherein the elongated member has a length greater than the diameter of the hitch ball hole.

16. A portable hoist assembly for lifting a hitch to be installed on the underside of a vehicle platform, wherein the hitch has a hitch ball hole and the vehicle platform has a hole to be aligned with the hitch ball hole when the hitch is installed, the combination of the hoist assembly and vehicle platform comprising:

a hoist frame positioned on the vehicle platform;

a winch adapted to pay out and draw in a cable wherein the winch is supported by the frame above the vehicle platform hole; and an elongated member attached to the cable wherein the elongated member can be oriented in:

a first orientation for passing through the vehicle platform hole and the hitch ball hole; and a second orientation wherein the elongated member cannot pass through the hitch ball hole;

whereby the elongated member can be lowered through the vehicle platform hole and the hitch ball hole in the first orientation and can secure the cable to the hitch in the second orientation.

17. The portable hoist assembly of claim 16 wherein the elongated member comprises a tube.

18. The portable hoist assembly of claim 17 wherein the tube has a length less than the diameter of the hitch ball hole and elongated member further comprises a pin that can be positioned within the tube and that has a length greater than the diameter of the hitch ball hole.

19. The portable hoist assembly of claim 16 wherein the elongated member comprises a pin.

20. The portable hoist assembly of claim 16 wherein the elongated member has a length greater than the diameter of the hitch ball hole.

* * * * *